United States Patent [19]

Kienast

[11] 4,210,291

[45] Jul. 1, 1980

[54] ROLLER MILL

[75] Inventor: Hans Kienast, Vienna, Austria

[73] Assignee: Erste Osterreichische Zahnraderfabrick Rudolf Kienast Gesellschaft m.b.H., Vienna, Austria

[21] Appl. No.: 923,664

[22] Filed: Jul. 10, 1978

[51] Int. Cl.[2] ..... B02C 15/00

[52] U.S. Cl. ..... 241/110; 241/117

[58] Field of Search ..... 241/110, 114, 117, 121, 241/107, 111, 252

[56] References Cited

U.S. PATENT DOCUMENTS

| | | | |
|---|---|---|---|
| 1,016,644 | 2/1912 | Peckelsen | 241/117 X |
| 3,656,695 | 4/1972 | Bacharach | 241/117 X |

*Primary Examiner*—Richard B. Lazarus

*Attorney, Agent, or Firm*—Cushman, Darby & Cushman

[57] ABSTRACT

A rolling mill having a rotary bowl supported on a casing of a step-down drive transmission has two parallel gear trains leading from a common input shaft to a spur output gear wheel arranged horizontally beneath the bowl. A vertical drive shaft is splined at opposite ends and transmits the gear wheel drive, without relative rotation to the bowl. The bowl is provided with horizontal and vertical bearings which are separate from the bearings of the output gear wheel. The drive shaft, by canting slightly, is able to transmit drive without lateral thrusts from the bowl to the gear wheel. As a result, wear of the gear wheel teeth produced by small misalignments of the axis of the bowl and gear wheel during operation of the mill is avoided and the life of the mill is prolonged. Provision is made for vertical removal of the shaft and the splined diameter at the lower end is less than that at the upper end to facilitate this. Involute teeth are used for the splines.

8 Claims, 3 Drawing Figures

ROLLER MILL

This invention relates to a roller mill having a drive system for rotating a milling bowl and is more specifically concerned with a roller mill of the type comprising: a milling bowl which rotates about a vertical axis and contains at least one milling roller; a thrust bearing for absorbing downward forces on the bowl; and a vertical shaft for transmitting drive, without relative rotation, to the bowl from an axially-vertical output gear which provided at the output end of a step-down drive transmission. The shaft may drive the bowl directly or drive a support on which the base of the bowl rests and which is attached to the bowl so that they rotate together. Such a roller mill is hereafter referred to as being "of the type described".

Roller mills of the type described have a very large weight. The milling bowl itself usually has a weight of several tonnes and can have a diameter of several meters. The milling rollers are hydraulically or hydropneumatically pressed against the milling bowl with large forces. In known roller mills of the type described the milling bowl is rigidly connected to a support, formed by an output drive flange, and bears against the transmission housing by means of a bearing. The output drive flange is keyed on the output shaft of the output gear wheel associated with the transmission or is connected thereto by means of a press fit and the milling bowl of the output drive flange is supported against lateral forces by making use of radial bearings of the output shaft. Accordingly, the transmission bearings are stressed by the lateral forces imposed by the milling bowl. In view of the large diameter of the milling bowl the support thereof calls for a thrust bearing of very large diameter and the unavoidable inaccuracies of such a large thrust bearing, which occur during manufacture or in the course of operation as a result of wear, can result in axial deviations between the output gear wheel of the step-down transmission and the milling bowl. These in turn give rise to substantial lateral forces. Furthermore, the rollers which circulate in the milling bowl also apply substantial lateral forces thereto. All these lateral forces must be absorbed by the bearing of the output gear wheel. If the bearing of a transmission output gear wheel wears as the result of constant and high stresses it follows that the teeth of the gear wheel will also be subjected to substantial wear and in the course of operation such wear will affect the teeth and the bearing of the gear wheels disposed between the input shaft of the step-down transmission and the output gear wheel. For this reason damage to the step-down transmission frequently occurs in the course of operation roller mills of the type described and such damage necessitates the replacement of exceptionally costly gear wheels and their bearings.

An object of this invention is the provision of an improved roller mill.

In accordance with the present invention a roller mill of the type described has a first bearing assembly positioned to absorb horizontal zones exerted by the bowl, a second bearing assembly independent of the first bearing assembly and in which the output gear wheel rotates, and shelf-centering coupling arrangement through which drive is transmitted from the output gear wheel via the shaft to the bowl. The shelf-centering nature of the coupling arrangement, conveniently provided by two separate couplings, serves to compensate for inaccuracies in the axial alignment of the output gear wheel and the bowl when the mill is operating.

Thus wear on the drive transmission is lessened, as a result, the step-down transmission absorbs only torsional forces for which it is designed and any transmission of lateral forces from the milling bowl to the transmission gear wheels and their bearings is reliably avoided since the milling bowl is supported by the radial bearing against lateral forces, independently of the bearing of the output gear wheel. The technique utilized by the invention compensates for axial misalignments between the milling bowl (or the support base on which it stands) and the output wheel gear while the milling bowl itself is supported in conventional manner by a thrust bearing. Transmission damage is thus avoided and the service life of the transmission is substantially increased.

Avoiding the back transmission of lateral forces from the bowl or obtaining the shelf-centering coupling action by the output shaft could theroetically be achieved, for example, by interposing a flexible coupling in the output drive shaft. Such flexible couplings however would represent an additional component and would have a very large circumference in view of the large driving torques which have to be transmitted. This is avoided in the invention by having the output drive shaft itself preferably shelf-centeringly coupled at one end to the output gear wheel and at the other end to the milling bowl. Axial misalignments can thus be absorbed at the coupling at the output drive shaft ends. According to one preferred embodiment of the invention the shaft is coupled to the output gear wheel and to the milling bowl by means of spline shaft connections. Such a spline shaft connection is able to absorb minor lateral displacements or canting of the shaft and this is sufficient to prevent the transmission of lateral forces from the milling bowl to the transmission gear wheels. Spline shaft connections whose teeth have involute flanks are particularly well suited to this end. Self-centering coupling action which compensates for axial misalignment, can also be wholly or partially assisted if the shaft is made sufficiently long to absorb such inaccuracies by elastic bending. Preferably the output gear wheel has a downwardly extended neck which has the mating profile of the spline shaft connection. Lengthening the distance between the two couplings of the output drive shaft not only enables the coupling shaft to compensate for at least part of the axial misalignment by elastic bending but also provides the effect whereby the compensation of a given axial misalignment can be achieved by slight canting of the output shaft through a smaller canting angle.

In the preferred embodiment of the invention the diameter of a spline shaft connection, which couples the shaft to the output gear wheel, is smaller than the diameter of a second spline shaft connection which couples the output shaft to the milling bowl. The output shaft can then be easily retracted upwardly through an opening which may be provided in the milling bowl and/or in the base support thereof, above the output shaft. This offers special advantages. Withdrawing the shaft upwardly is readily possible in the case of a spline couplings. After withdrawing the shaft, the milling bowl, and the base support thereof which may be provided, can be hoisted by means of a crane so that repairs can be performed on the bowl radial bearing as well as on the bowl thrust bearing. The thrust bearing frequently comprises a plain bearing and, more particularly in view of the large bearing diameter, such a plain bearing must be aligned by surface scraping.

This calls for frequent lifting of the milling bowl, where applicable together with its supports, from the bearing surface of the plain bearing and in each case, after surface scraping, the milling bowl must again be set into rotation. In this case the withdrawal arrangement of the output shaft offers a special advantage since the output drive shaft can be readily re-inserted after surface scraping and the milling bowl can be operationally driven for rotation.

According to another preferred embodiment of the invention the step-down transmission is a power dividing transmission in which torque is transmitted from an input shaft through two parallel trains of gear wheels to the output gear wheel which is formed by a spur gear. A power dividing transmission of this kind permits a lighter weight of transmission with gear wheels which have narrower tooth widths and therefore enable a reduced overall height for the transmission to be used. For any given dimensions the height, saved by the reduced overall height of the step-down transmission, can be utilized for reinforcing a cover plate of the transmission casing and for accommodating the radial first bearing which supports the milling bowl. Since the cover plate must support the weight of the milling bowl, including the forces applied by the rollers to the milling bowl and since the operational reliability of each hydrodynamic or hydrostatic thrust bearing incorporated between the milling bowl or its support and the cover plate depends to a large extent on the stiffness thereof, it follows that any possible reinforcement of the cover plate is of special advantage.

The invention will now be described in more detail, by way of example, with reference to the accompanying diagrammatic drawing, in which:

FIGS. 2 and 3 show in section a transmission with the 2 thrust bearing for the milling bowl, FIG. 2 being a vertical section through the transmission while FIG. 3 shows a horizontal section.

Figure 1:
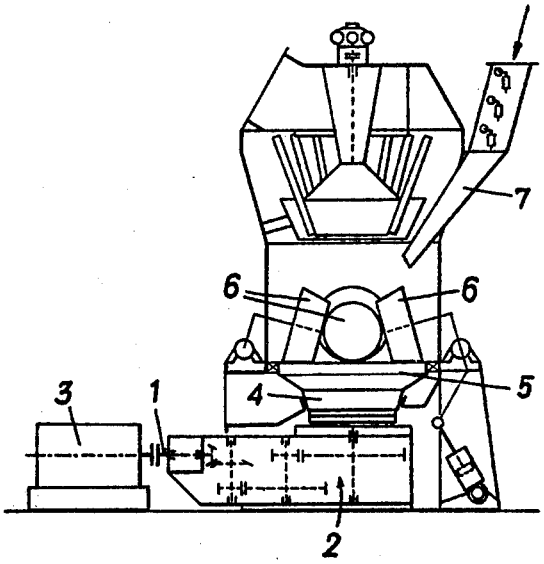
FIG. 1 is a view of a roller mill.

As shown in FIG. 1 an input shaft 1 of a step-down transmission 2 is driven by an electric motor 3. A support 4 of a milling bowl 5 is supported on a casing 9 of the step-down transmission 2 and is rigidly bolted to the milling bowl 5. An output spur gear wheel 13 of the step-down transmission 2 is arranged coaxially with the milling bowl 5. Two to four rollers 6 are supported on the milling bowl 5 and are set into rotation by the rotation of the milling bowl itself. The material for grinding is supplied through a hopper 7.

Figures 2, 3:
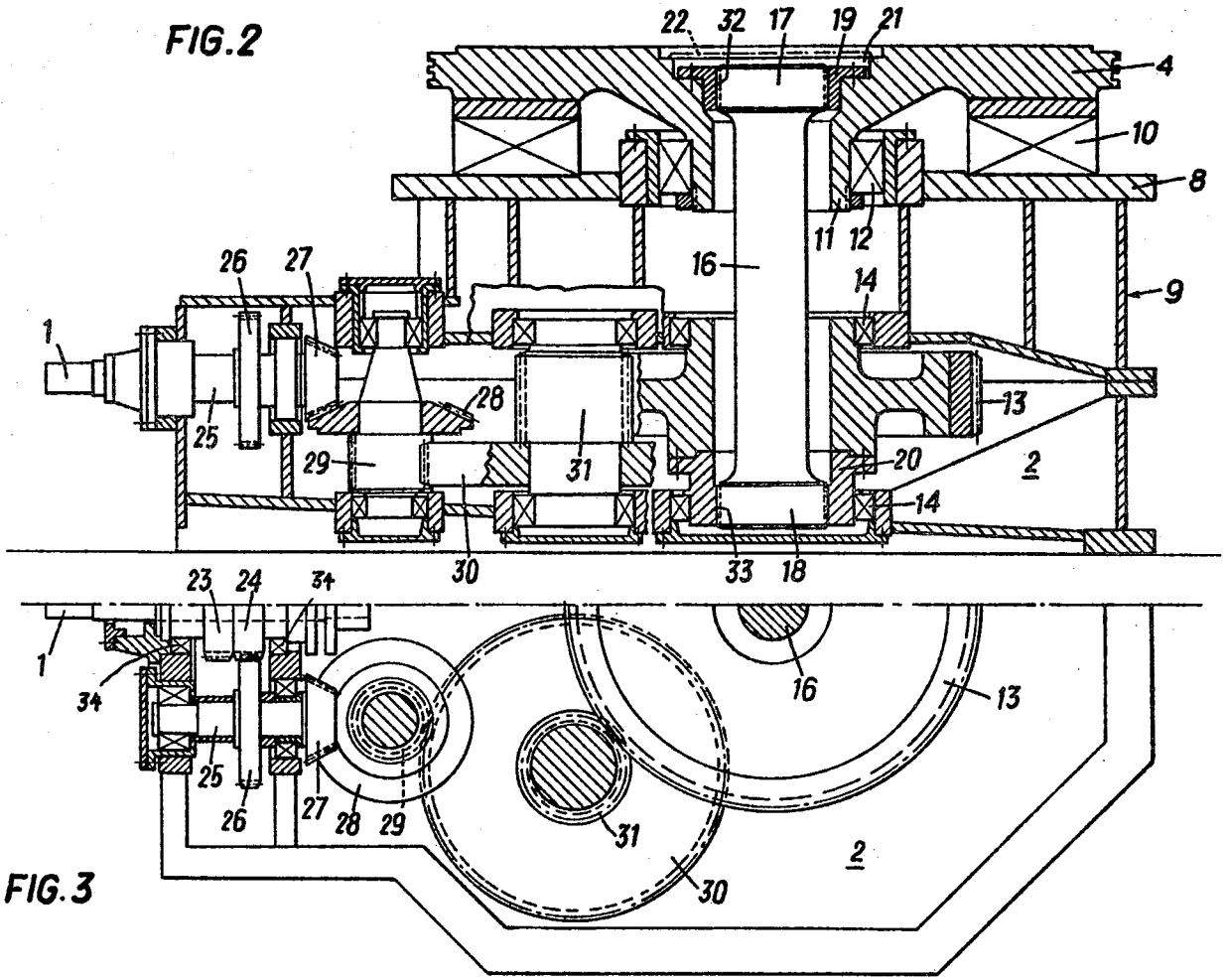

FIGS. 2 and 3 show the step-down transmission and the bearing of the milling bowl to an enlarged scale. The support 4, bolted to the milling bowl 5, is supported by a thrust bearing 10 on a cover plate 8 of the casing 9 of the step-down transmission 2. The support 4 of the milling bowl 5 is constructed with a neck 11 which is supported in the cover plate 8 by a radial bearing 12 which is constructed as a shelf centering bearing.

The output gear wheel 13 is supported in the transmission casing 9 by means of two self-aligning bearings 14. The thrust bearing 10 and the radial bearing 12 of the milling bowl are completely independent of the bearings 14.

An output shaft 16 is arranged vertically in the casing 9. The top end 17 is non-rotationally coupled to the support 4 of the milling bowl 5 and the bottom end 18 of the output shaft 16 is nonrotationally connected to the output gear wheel 13. Tooth profiles of the top end 17 engages with mating profiles of a component 19 and Tooth profiles of a bottom end 18 of the shaft 16 engage with mating profiles of a lower component 20. These centerengaging teeth at the two ends of the shaft 16 provide Spline connections 32 and 33 which have involute flanks. Such a spline shaft connection with an involute profile is suitable for absorbing minor axial inaccuracies, due either to lateral axial displacement or canting, without substaining damage. The bearings 14 of the output gear wheel 13 are therefore not detrimentally affected by inaccuracies of the bearing 12 associated with the support 4 of the milling bowl 5. The lower component 20 is formed by a downwardly extended neck of the output gear wheel 13. The upper component 19 is inserted into the support 4 at the top thereof. The distance between the shaft ends 17 and 18 is therefore increased in this manner so that axial inaccuracies can be more readily absorbed by a lessening in the cant angle for a given eccentricity. The bottom bearing 14 of the output gear wheel 13 is also disposed on the lower component 20 which forms the elongated neck. The spline shaft connection 33 has a slightly smaller diameter than the spline shaft connection 32. An opening 21, covered by a removable lid 22, is provided coaxially above the output shaft 16 and in register with an opening in the base of the milling bowl 5 so that the output shaft 16 can be withdrawn upwardly without removing the bowl 5. If the milling bowl itself is not provided with such an opening it is first necessary to detach the milling bowl 5 from the support 4.

The drive provided by the input shaft 1 is transmitted via two interconnected helically toothed gear wheel 23 and 24 to two shafts 25 by means of spur gears 26 which are rigidly keyed on to the said shafts. Power is transmitted from the shafts 25 via bevel pinions 27, bevel gears 28, spurgear pinions 29, spurgears 30 and spurgear pinions 31 to the output gear wheels 13. The drive from the input shaft 1 is therefore transferred via two trains of gear wheels to the output spurgear 13 and the half plan view shows only one of the two trains which receive their drive via the spurgear 24. The second spurgear train, not shown, receives its drive from the spurgear 23. The spurgears 23, 24 have helical teeth whose pitch is oppositely oriented and they are rigidly coupled to each other and are axially slidable in the bearings 34. Accordingly these gear wheels can so adjust themselves that despite possible machining inaccuracies the driving power is uniformly distributed over both trains of gear wheels. Since each of the two trains is required to transmit only half the input power it follows that only half the tooth width is required for the gear wheels so that the overall height of the step-down transmission and the weight thereof can be reduced. Since reduction of the overall height can be utilized for reinforcing the cover plate 8 as previously mentioned.

We claim:

1. A roller mill having a drive system for rotating a milling bowl which rotates about a vertical axis and contains at least one milling roller, a thrust bearing located below the bowl for absorbing downward forces on the bowl, a vertical shaft coaxial with the bowl for transmitting drive without relative rotation to the bowl from an axially-vertical gear wheel provided at the output end of a step-down drive transmission, a first bearing assembly having a vertical axis coaxial with the axis of the bowl and surrounding an element which is fixed to said bowl for absorbing horizontal forces exerted by the bowl, a second bearing assembly independent of the first bearing assembly, said second bearing assembly being coaxial with said first bearing assembly and said output gear rotating in said second bearing assembly, and a self-centering coupling arrangement coaxial with the vertical shaft connecting said output gear with the vertical shaft and connecting the vertical shaft with the bowl for absorbing minor axial inaccuracies between the shaft and the bowl.

2. A mill as claimed in claim 1, in which two spaced self-centering couplings are provided in the arrangement, one connecting the shaft to the bowl and the other connecting the output gear wheel to the shaft.

3. A mill as claimed in claim 1 or claim 2, in which the coupling arrangement comprises sets of parallel splines at opposite ends of the shaft.

4. A mill as claimed in claim 3, in which the splines are provided by teeth having involute flank surfaces.

5. A mill as claimed in claim 1, in which the output gear wheel is formed with a central downwardly projecting neck and the coupling arrangement includes a spline connection between the inside of the neck and the outside of the lower end-portion of the shaft.

6. A mill as claimed in claim 5, in which the second bearing assembly includes a bearing supporting the output gear wheel and arranged between the neck and a casing of the step-down transmission.

7. A mill as claimed in claim 1, in which a removable cover closes an opening above the shaft and through which the shaft can be removed, and the self-centering coupling arrangement includes axial splines at opposite ends of the shaft, the diameter of the lower splined end of the shaft being less than that of the upper splined end such that the shaft can be removed vertically from its operating position in the mill by way of the opening.

8. A mill as claimed in claim 1, in which the step-down drive transmission includes two gear trains extending in parallel from a common drive input shaft to the output gear wheel which is formed as a spur gear.

* * * * *